United States Patent [19]

Solomon

[11] 4,022,348

[45] May 10, 1977

[54] STORAGE AND SHIPPING CONTAINER FOR GAS FILLED PELLETS

[75] Inventor: David E. Solomon, Ann Arbor, Mich.

[73] Assignee: KMS Fusion, Inc., Ann Arbor, Mich.

[22] Filed: Jan. 16, 1975

[21] Appl. No.: 541,446

[52] U.S. Cl. ..... 222/3

[51] Int. Cl.² ..... B67B 7/24

[58] Field of Search ..... 222/146 H, 146 HE, 54, 222/3; 55/16, 58, 62–66, 74, 158, 208; 220/9 D, 10

[56] References Cited

UNITED STATES PATENTS

| | | | |
|---|---|---|---|
| 3,085,379 | 4/1963 | Hiyonaga et al. | 55/58 X |
| 3,307,330 | 3/1967 | Niedzielski et al. | 55/16 |
| 3,335,550 | 8/1967 | Stern | 55/208 |
| 3,438,178 | 4/1969 | Betteridge et al. | 55/58 |
| 3,452,517 | 7/1969 | Buckland | 55/158 |
| 3,713,273 | 1/1973 | Cuffee | 55/74 |

FOREIGN PATENTS OR APPLICATIONS

| | | | |
|---|---|---|---|
| 961,925 | 6/1964 | United Kingdom | 55/66 |

*Primary Examiner*—Allen N. Knowles
*Assistant Examiner*—Hadd Lane
*Attorney, Agent, or Firm*—Barnes, Kisselle, Raisch & Choate

[57] ABSTRACT

A container for the storage, shipping and dispensing of pellets filled with gases such as hydrogen, deuterium, tritium, or mixtures of the same which has compactness, which is safe against fracture or accident, and which is reusable. The container consists of an outer housing with suitable inlet and outlet openings and electrical feed elements, the housing containing an activated sorber material in the form, for example, of titanium sponge or an activated zirconium aluminate cartridge. The gas to be stored is introduced into the chamber in the form of small spheres of material such as glass, plastic or plastic-carbon, or other materials which typically contain hydrogen isotopes. A specified quantity of filled pellets are introduced into the chamber after which it is evacuated and the sorber baked out by heating. Thus, any breakage in transit of the pellets will permit the gas to be sorbed and prevent release until the cartridge is again reheated.

4 Claims, 1 Drawing Figure

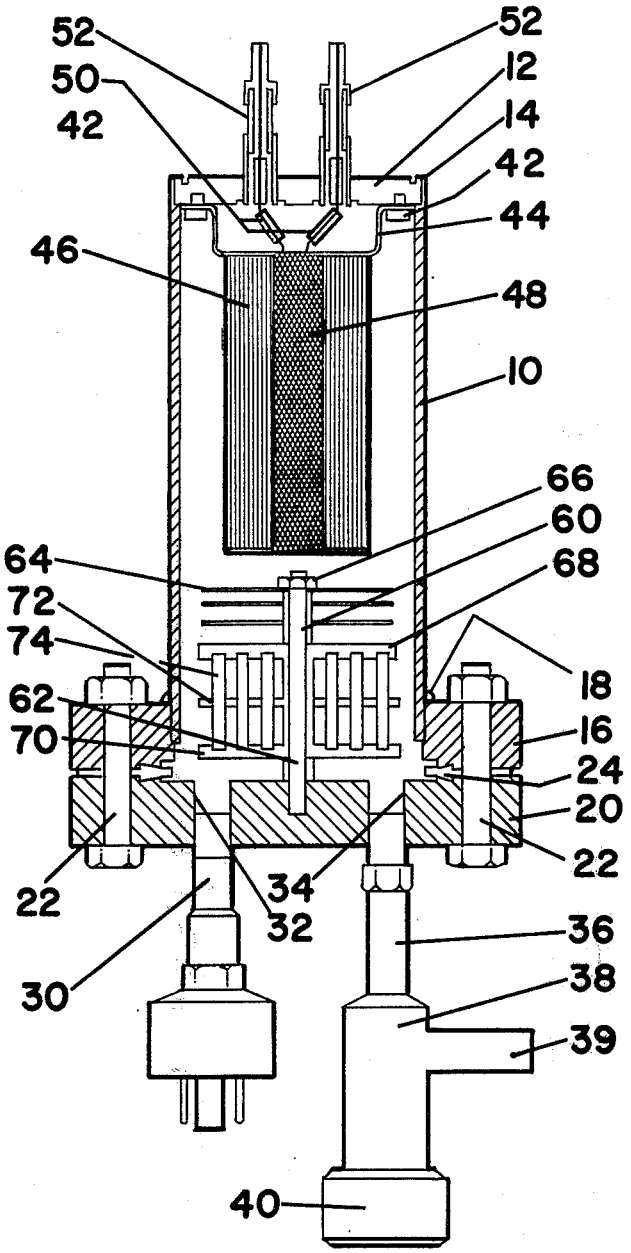
52
52
50
42
12
14
42
44
46
48
10
66
60
64
68
72
74
18
62
16
70
24
20
22
22
34
32
36
30
38
39
40

STORAGE AND SHIPPING CONTAINER FOR GAS FILLED PELLETS

This invention relates to a Storage and Shipping Container for Gas Filled Pellets and more particularly to a container which can be utilized to store, to ship and to dispense gases such as hydrogen isotopes which may be dangerous when released without control.

Reference is made to my copending application, Ser. No. 541,447, filed Jan. 16, 1975, on a "Container for Hydrogen Isotopes."

With the increasing interest in the achievement of thermonuclear fusion of hydrogen isotopes by exposure to high energy sources, it has become a problem to store, transfer and dispense the gases used in this process such as hydrogen, deuterium, tritium or mixtures of these gases. The tritium gas, of course, is hazardous to human beings when inhaled in any substantial quantities and the hydrogen is explosive and highly inflammable. It is thus important that it be possible to handle these gases in a safe manner. Reference is made to a copending application of Robert J. Teitel, Ser. No. 481,708, filed June 21, 1974, on a "Process and Apparatus for Achieving Hydrogen Storage and Dispensing."

It is thus an object to provide a container for hydrogen isotopes which is extremely compact, which is safe against catastrophic failures such as fracture of the container or other inadvertent happenings and which is also reusable.

Briefly, the invention comprises utilizing a shipping container with a storage rack for a quantity of filled pellets, the container also including sorber material for gases which, when placed in a receptive state by exposure to vacuum and heat, will be in a condition to sorb gases that might be released from any fractured pellets during the course of transportation.

Other objects and features of the invention relating to details of construction and operation will be apparent in the following description and claims in which the principles of the invention are set forth, together with the utility and in connection with the best mode presently contemplated for the practice of the invention.

A drawing accompanies the disclosure and the single view thereof may be briefly described as a sectional view of a storage and shipping container illustrating the various elements important to the construction and operation.

REFERRING TO THE DRAWINGS

The dispenser is shown having a cylindrical shell 10 provided with a stationary head end 12 which is welded in an annular groove at the end of the casing at 14 to seal this part of the container. The other end of the container is surrounded by a solid ring 16 which is suitably welded at 18 to the container in an annular groove. A removable head 20 can be applied over the ring 16 and held together by heavy hexagonal head bolts 22 distributed around the periphery of the head 20 and the ring 16. A suitable vacuum seal 24 is provided between the ring and the head. A thermocouple type vacuum gauge 30 is inserted into an opening 32 in the head 20. Another opening 34 receives a threaded pipe 36 which supports a valve 38. This valve 38 having an inlet-outlet pipe 39 has a control knob 40 and may be used for the ingress and egress of gas to and from the chamber.

The permanent head 12 has supported on the inside thereof by hex bolts 42 a bracket 44 which in turn supports a cartridge 46 of a reversible sorber material. One such sorber material is activated zirconium aluminate which is commercially available from SAES-Getters USA. A cartridge heater 48 is provided adjacent the cartridge. The electrical connections for this heater are shown at 50 and these pass out through sealed electrical feed-through tubes 52.

The storage unit for the material to be transported is supported on a central shaft 60 which is secured in a drilled recess 62 at the center of the base 20. At the top of this shaft are three spaced heat shields 64 held in spaced relation and secured by a nut 66. Below the heat shields is a rack formed of a top plate 68 and a bottom plate 70 with a spacer element 72. A plurality of pellet cassettes 74 is positioned in spaced relation between the plates 68 and 70 with the ends recessed in suitable openings in the plates to provide spaced storage. The pellet cassettes may each contain a large number of small spheres formed of glass, plastic or carbon which are filled with gas. One example of the use is the transportation and storage of hydrogen isotopes which may be pure hydrogen, deuterium, tritium or a mixture of these gases. The spheres are charged with this gas by a means of heating the pellets in the presence of the gas under pressure so that the gas permeates through the walls of the pellets to the interior. Upon cooling of the pellets, the gas can be easily retained at atmospheric pressure. The pellet cassettes are then loaded with the small spheres which may range in diameter from 10 to 300 micrometers. Each pellet cassette, therefore, can contain a large number of these small spheres.

The pellet cassettes can be loaded at atmospheric pressure and hermetically sealed. In some cases, it may be desirable to load them under a certain specified pressure.

In the use of the device, the bottom plate 20 is removed from the plate 16 by removing the bolts 22; the supporting post or shaft 60 is loaded into the recess 62 carrying the assembled pellet cassette holder and the heat shields. The device is then reassembled with the vacuum flange seat 24 so that the entire unit is hermetically sealed. The next step is to heat the cartridge 48 to a temperature of, for example, 800° C. and also at the same time to subject the interior of the container 10 to a high vacuum through the pipe 39 and using the valve 38. When the evacuation and the bake-out of the cartridge by use of the internal heater is complete, the evacuation valve 38 is closed and the container is ready for transport. Should any of the pellet cassettes or spheres be ruptured, releasing the gas into the interior of the container 10, the gas will be immediately sorbed into the zirconium aluminate cartridge, where it will be retained in a stable form. For example, with tritium, it would be in the form of $ZrAlT_2$. When the shipment reaches its destination, the pellet cassettes can be unloaded by opening again the plate 20 and removing the cassettes. If desired, the container can be evacuated and the cartridge heated prior to the removal to insure that any released hydrogen or tritium is safely removed before the cartridge is opened.

Materials that might be used as the sorber material are (1) titanium sponge, (2) zirconium metal foil, (3) hafnium wire, (4) scandium film, (5) aluminum oxide (ZEOLITE) pellets, or (6) zirconium aluminate.

Inasmuch as the United States Atomic Energy Commission requires a double containment unit for storage and shipment of materials such as tritium, the chamber 10 could be fitted inside another container which could also contain a ZrAl cartridge although this might not be necessary.

I claim:

1. A method of preparing for shipping gas filled pellets containing inflammable, toxic or radioactive material which comprises:

a. loading a quantity of charged pellets into a portion of the space within a closed container, b. providing a quantity of sorber material in the remaining space in said container having sorber characteristics specific to the gas in said pellets, c. heating and evacuating said container and sorber material to render the sorber material ready and receptive to gases within said charged pellets, and d. sealing said container for shipment.

2. A package device for safe shipping of a quantity of pellets containing a gas which comprises:

a. an outer container, b. a closure to seal said outer container movable to permit loading and removal of an inner container, c. one or more inner containers lodged and secured inside said outer container to occupy a portion of the space within said outer container, d. a plurality of pellets containing a gas within said inner container, and e. a cartridge of material which is a sorber for the gas contained in said pellets supported in said outer container together with said inner container, said sorber material being in a state of receptivity to the gas contained in said pellets to sorb said gas in the event of breakage of said pellets.

3. The package device as defined in claim 2 in which an electric heater is supported in said container adjacent said cartridge to permit heating said cartridge to place in a state of receptivity and for dispensing of a gas therefrom.

4. The package device as defined in claim 3 in which a heat shield is disposed in said container between said cartridge and said inner container.

* * * * *